United States Patent [19]

Tamagawa

[11] Patent Number: 4,927,495

[45] Date of Patent: May 22, 1990

[54] SUPPORT FOR PHOTOGRAPHIC PRINTING PAPER

[75] Inventor: Shigehisa Tamagawa, Shizuoka, Japan

[73] Assignee: Fuji Photo Film Co., Ltd., Kanagawa, Japan

[21] Appl. No.: 237,369

[22] Filed: Aug. 29, 1988

[30] Foreign Application Priority Data

Aug. 29, 1987 [JP] Japan ..... 62-216013

[51] Int. Cl.[5] ..... D23E 3/04; B41C 1/10

[52] U.S. Cl. ..... 162/135; 162/169; 162/206; 427/316; 427/326; 427/391; 427/395

[58] Field of Search ..... 162/206, 135, 169; 427/395, 391, 316, 326

[56] References Cited

U.S. PATENT DOCUMENTS

| | | | |
|---|---|---|---|
| 3,647,619 | 3/1972 | Mack et al. | 162/206 |
| 4,115,603 | 9/1978 | Shaw | 162/135 X |
| 4,139,410 | 2/1979 | Tapio et al. | 162/206 |
| 4,665,014 | 5/1987 | Katsura | 162/135 X |

*Primary Examiner*—Peter Chin
*Assistant Examiner*—Thi Dang
*Attorney, Agent, or Firm*—Sughrue, Mion, Zinn, MacPeak & Seas

[57] ABSTRACT

A support for photographic printing paper containing a base paper having polyolefin coated on both surfaces thereof, wherein as the base paper is used a one side-machine glazed paper having a glossy surface which is obtained by bringing one surface of a wet paper into intimate contact with the mirror surface of a heated mirror surface type drier and drying.

8 Claims, No Drawings

SUPPORT FOR PHOTOGRAPHIC PRINTING PAPER

FIELD OF THE INVENTION

The present invention relates to a support for photographic printing paper, and more particularly, to a support for photographic printing paper having a surface of high smoothness.

BACKGROUND OF THE INVENTION

In recent years, a photographic printing paper capable of being quickly developed comprising a water resistant support consisting of a base paper having a polyolefin such as polyethylene and the like coated on both sides of the paper has been widely used.

Such supports for photographic printing paper, consisting of a base paper with a polyolefin layer coated on both sides thereof, may be divided into two groups: one is such that surface is glazed and the other is such that the surface is matted or provided with a pattern such as a silk web or the like. Of these, a support having no pattern at all and having a smooth, glossy surface is said to be better, and a support in which irregularities on both sides are moved as much as possible and which has a mirror-like smooth surface is particularly preferred.

In order to obtain such smooth supports, it has been proposed, for example, to use paper comprising a pulp having a fiber length of not more than 0.4 μm and a void amount (pore diameter of 0.4 μm or less) of at least 0.4 ml/g as the base paper constituting the support (JP-A-60-67940) (the term "JP-A" as used herein refers to an "unexamined published Japanese patent application"), to use a paper comprising a wood pulp having a mean fiber length of 0.4 to 0.9 mm, a mean fiber width of at least 13.5 μm and a mean fiber thickness of not more than 4 μm as the base paper (JP-A-60-69649), to use a paper comprising a mixture of natural pulp and 5 to 60 wt% of hydrophobic fibers (JP-A-61-275752), or to specify water removing conditions in obtaining a wet paper from a pulp slurry by the use of a two wire papermaking machine (JP-A-61-284762). In addition, an attempt has been made to increase the density of the base paper component to be used in the support for a photographic printing paper by calendering the base paper between metallic rolls and in this calendering, increasing the pressure, i.e., the pressure of the machine calender.

For coating with a polyolefin, e.g., polyethylene and the like, the extrusion coating method, i.e., the method of coating by extruding the polyolefin melted at an elevated temperature on the surface of the base paper, has generally been employed. In order to increase the smoothness of the support for a photographic printing paper, attempts such as increasing the thickness of the polyolefin coating layer and increasing the pressure applied at the time of polyolefin coating have been employed.

The above attempts in coating with polyolefin, however, are not sufficiently effective and are disadvantageous from an economic standpoint. The above methods to increase the density of the base paper have disadvantages in that problems with respect to appearance such as blacking and paper cockle readily occur. In summary, by any of the conventional methods, a support for photographic printing paper having sufficiently high smoothness has not been obtained.

A support for a photographic printing paper having sufficiently high smoothness cannot be obtained only by the above-proposed methods such as selecting a specific pulp as a component of the pulp slurry or specifying the dehydration conditions for obtaining a wet paper from the pulp slurry.

SUMMARY OF THE INVENTION

An object of the present invention is to provide a support for a photographic printing paper which is free from blacking and paper cockle, that is, is of high smoothness, and further is advantageous from an economic standpoint.

As a result of extensive investigations to overcome the above problems of the prior art, it has been found that very good results can be obtained by using a one side-machine glazed paper having a sufficient smoothness of the back thereof, the paper having been considered to be unsuitable to use as the base paper for printing paper because a poor smoothness of the back surface of one side-machine glazed paper adversely effects the smoothness of the front surface thereof when it is subjected to the polyolefin coating.

Move particularly, it has been found that the above object is attained by using a support for a photographic printing paper comprising a base paper having a polyolefin coated on both surfaces thereof, wherein the base paper comprises a one side-machine glazed paper having a glossy surface which is obtained by bringing one surface of a wet paper into intimate contact with the mirror surface of a heated mirror surface type drier and then drying.

DETAILED DESCRIPTION OF THE INVENTION

The base paper to be used as the support for photographic printing paper of the present invention is selected from materials commonly used in photographic printing paper. That is, natural pulp selected from coniferous tree, broad-leafed tree and the like, and if desired, a filler such as clay, talc, calcium carbonate, fine particles of urea resin and the like, a sizing agent such as rosin, alkyl ketene dimer, higher fatty acid salts, paraffin wax, alkenylsuccinic acid, and the like, a paper strength reinforcing agent such as polyacrylamide and the like, a fixing agent such as aluminum sulfate, cationic polymer and the like, and so on added thereto may be used In addition, synthetic pulp, and a mixture of natural pulp and synthetic pulp in any desired ratio can be used. Those papers containing at least 60% by weight of broad-leafed tree pulp as short fibers are preferably used Since, however, the one side-machine glazed paper of the present invention can be increased in surface smoothness more easily than even the high quality paper obtained by the use of a multi-cylinder type drier (e.g., preferably a drier comprising at least ten driers having a small diameter) commonly used, it is also preferred that coniferous tree pulp be used in combination from viewpoints of paper strength such as stiffness and the like, and peeling properties from the Yankee drier. The preferred compounding ratio of broad-leafed tree pulp/coniferous tree pulp is 95/5 to 60/40.

The pulp surface can be subjected to surface sizing treatment by applying a film-forming polymer such as gelatin, starch, carboxymethyl cellulose, polyacrylamide, polyvinyl alcohol, polyvinyl alcohol derivatives and the like. The polyvinyl alcohol derivatives include carboxy-modified polyvinyl alcohol, silanol-modified polyvinyl alcohol, copolymers of polyvinyl alcohol and acrylamide, and the like. In the surface sizing treatment using the film-forming polymer, the amount of the film-forming polymer coated is preferably 0.1 to 5.0 g/m$^2$ and more preferably 0.5 to 2.0 g/m$^2$. To the film-forming polymer can be added, if desired, an antistatic agent, a fluorescent whitener, a pigment, a defoaming agent and the like.

The pulp slurry containing pulp to which additives such as a filler, a sizing agent, a paper strength reinforcing agent, a fixing agent and the like may be added as desired may be made into paper by the use of a paper-making machine such as a Fourdrinier wire machine and the like, and then dried by contacting against the mirror surface of a heated mirror surface drier and rolled to produce the base paper. Before or after the drying process, the above-described surface sizing treatment may be applied. A calender treatment may also be applied between the drying process and the rolling process.

As the base paper to be used as the support for photographic printing paper of the present invention, one side-machine glazed paper can be used, obtained by bringing a wet paper into intimate contact with the mirror surface of a heated mirror surface type drier such as Yankee drier and the like, and drying it.

Conditions for production of the above one side-machine glazed paper are not critical and vary with the composition of the pulp slurry, the size and type of material of the mirror surface of the heated mirror surface drier, and the like. The water content of the wet paper is preferably 50 to 8% wt% and particularly preferably 60 to 70 wt%. For the wet paper having a water content falling within the above-specified range, it is preferred to control the surface of the heated mirror surface drier to the range of 100° to 200° C.

The glazed surface of the one side-machine glazed paper as obtained above by contact with the mirror surface of the heated mirror surface drier is not only thereby made smooth and glossy, the surface fibers are also cornificated. Thus, at the time of polyolefin coating, troubles such as break of paper layer and the like do not occur, and even after it is used as a printing paper, reduction in smoothness does not occur at the developing and drying steps.

The smoothness of the glazed surface of the one side-machine glazed paper without coating with polyolefin is preferably made so that the Beck smoothness is at least 300 seconds.

With regard to the smoothness of the back surface of the base paper to be used as the support for photographic printing paper, when the smoothness of the back surface is less than 100 seconds and poor as in the conventional ones, the smoothness of the front surface of the base paper is sometimes reduced by the pressure applied in coating the back surface of the base paper through extrusion coating of polyolefin and, therefore, it is preferred to control the Beck smoothness of the back surface, which is treated by supercalender or pigment after the machine glazing treatment, to at least 100 seconds, with the range of 150 seconds and above being preferred.

In the usual one side-glazed paper, as the support to hold the wet paper against the mirror surface of the heated mirror surface drier in drying thereof, a material such as felt or cloth is used for air and vapor permeability and in consideration of dissipation of water from the wet paper and the like and, therefore, in many cases, the Beck smoothness of the back surface of the base paper so dried is not more than 30 seconds, and a further treatment is required.

The method for making smooth the back surface of the one side-machine glazed paper is not critical. For example, a method in which one side-machine glazed paper having a water content of 3 to 10%, more preferably 5 to 8%, is subjected to supercalendering treatment at a roll temperature of 30 to 120° C, more preferably 50 to 90° C, and at a pressure between rolls of 50 to 500 kg/cm, more preferably 100 to 300 kg/cm; a method in which a smooth coating film is formed by coating a coating solution containing a binder such as styrene-butadiene rubber (SBR), methyl methacrylate-butadiene rubber (MBR), polyvinyl alcohol (PVA), starch and the like and, if necessary, further a filler such as clay, kaolin, calcium carbonate, titanium oxide and the like by the use of, e.g., a size press, a gate roll coater, a billblade coater, an air knife coater and the like; a method in which the above supercalendering treatment and the coating film-forming method are applied in combination; and so on can be employed As the base paper to be used as the support for the photographic printing paper, one side-machine glazed paper finally controlled to a thickness of 50 to 300 μm is preferably used.

The support for the photographic printing paper of the present invention is obtained by coating polyolefin on both surfaces of the above base paper.

The polyolefin resin includes homopolymers of α-olefins such as polyethylene, polypropylene and the like, and the mixtures thereof. Particularly preferred polyolefins are high density polyethylene, low density polyethylene and a mixture thereof. There are no specific limitations to the molecular weight of the polyolefin as long as it can be extrusion-coated. Usually, a polyolefin having a molecular weight of 20,000 to 200,000 is used.

The thickness of the polyolefin resin-coated layer is not limited, and can be determined depending on the thickness of the conventional polyolefin resin-coated layer for the support used for the printing paper. The thickness of each polyolefin layer is usually 15 to 50 μm.

To the polyolefin resin layer, known additives such as a white pigment, a colored pigment or a fluorescent whitener, an antioxidant and the like can be added. Particularly to the polyolefin resin layer on the side on which a photographic emulsion is coated, a white pigment and a colored pigment are preferably added.

As the apparatus for extrusion coating of polyolefin, an extruder commonly used for the extrusion of polyolefin and a laminate may be used.

A photographic printing paper is produced by coating and drying a photographic emulsion layer on the glazed surface of the support for photographic printing paper of the present invention. On the other surface, a print maintaining layer as described in, for example, JP-A-62-6256 can be provided.

In the base paper constituting the support for photographic printing paper of the present invention, one side-machine glazed paper having a glossy surface as obtained by bringing one surface of a wet paper into intimate contact with the mirror surface of the heated mirror surface type drier is used followed by further improving the smoothness of the back thereof, and, therefore, even by coating polyolefin on both surfaces of the base paper in a thin layer form, there can be obtained a support for photographic printing paper which is excellent in smoothness. The support for the photographic printing paper thus obtained is free from blacking and paper cockle, is smooth, is advantageous from an economical standpoint, and, therefore, is suitable as a glossy surface printing paper.

The present invention is described in greater detail with reference to the following example, although it is not intended to be limited thereto. Unless otherwise specified, all parts, percents and ratios are by weight.

EXAMPLE

Preparation of Samples

Sample No. 1:

A mixed pulp of 20 parts of NBSP (Nadel holz Bleached Sulfite Pulp) and 80 parts of LBKP (Laub holz Bleached Kraft Pulp) was beated to 300 cc (C.S.F.) (Canadian Standard Freeness) by the use of a double disc refiner. To the resulting base paper, 0.5 part of cationic polyacrylamide, 0.3 part of polyamidepolyamine epichlorohydrin and 0.5 part of alkyl ketene dimer, all parts based on the weight of the dried pulp, were added, and the resulting mixture was made into paper by the use of Fourdrinier wire machine and dried by the use of a Yankee drier to obtain a one side-machine glazed paper having a basis weight of 150 g/cm$^2$. This paper was subjected to supercalendering and adjusted to a thickness of 148 μm to obtain a base paper as a support for a photographic printing paper. The Beck smoothness of the top surface of the paper (Yankee drier surface) was 341 seconds, and the Beck smoothness of the back surface was 129 seconds.

Sample No. 2:

On the back surface of the one side-machine glazed paper before the calendering in the preparation of Sample No. 1, a coating solution of kaolin and SBR latex (absolutely dry weight ratio =4:1) was coated in an amount (as solids) of 1.5 g/m$^2$, and then calendering was applied to control the thickness to 148 μμm. The Beck smoothness of the top surface was 345 seconds, and the Beck smoothness of the back surface was 201 seconds.

Sample No. 3:

The same base paper as used in the preparation of Sample No. 1 was made into paper by the use of Fourdrinier wire machine and dried by the use of a Yankee drier to obtain a one side-machine glazed paper having a basis weight of 130 g/m$^2$. Without application of calendering, the one side-machine glazed paper was used as a base paper as a support for photographic printing paper. The thickness was 150 μm, the Beck smoothness of the top surface was 303 seconds, and the back surface was 35 seconds.

Comparative Sample No. 1:

The same base paper as used in the preparation of Sample No. 1 was made into paper by the use of Fourdrinier wire machine and dried by the use of a multicylinder type drier, and then calendering was applied to obtain a base paper having a basis weight of 149 g/m$^2$ and a thickness of 149 μm. The Beck smoothness of the top surface was 170 seconds and the Beck smoothness of the back surface was 143 seconds.

Comparative Sample No. 2:

On the back surface of the base paper before the calendering in Comparative Sample No. 1, the same coating solution as used in the preparation of Sample No. 2 was coated in an amount of 1.6 g/m$^2$, and then calendering was applied. The thickness was 149 μm, the Beck smoothness of the top surface was 192 seconds, and the Beck smoothness of the back surface was 233 seconds.

Evaluation of Samples:

Sample Nos. 1 to 3 of the present invention and Comparative Sample Nos. 1 and 2 as obtained above were each coated with the same polyethylene by extrusion coating using the same laminator to produce five water resistant supports. The thickness of the polyethylene layer applied on both surfaces of the supports was 28 μm in any of the supports. The polyethylene layer on the photographic emulsion side was made a mirror surface of the cooling roll surface of the laminator to obtain a glossy surface support. These supports were each coated with a conventional gelatin/silver halide photographic emulsion, and exposed to light and developed, and the smoothness of both surfaces of the printing paper was visually determined. A five point rating scale was made: 5 was the best smoothness, 1 was the worst smoothness, with less than 2 having no product value. The results are shown in Table 1.

TABLE 1

| Sample No. | Smoothness of Printing Paper |
|---|---|
| No. 1 (Invention) | 4 |
| No. 2 (Invention) | 5 |
| No. 3 (Invention) | 3 |
| No. 1 (Comparison) | 1 |
| No. 2 (Comparison) | 2.5 |

It can be seen from the results of Table 1 that the smoothness of a printing paper using the support for printing paper of the present invention is very good.

While the invention has been described in detail and with reference to specific embodiments thereof, it will be apparent to one skilled in the art that various changes and modifications can be made therein without departing from the spirit and scope thereof.

What is claimed is:

1. A process for producing a support for a photographic printing paper, comprising contacting a wet paper having a front and a back surface and having a water content of between 50 and 80 wt% against the mirror surface of a mirror surface type drier which mirror surface is maintained in the range of 100° C. to 200° C., to obtain a base paper having a Beck smoothness of at least 300 seconds at the front surface of the base paper, further subjecting the paper to treatment as necessary to impart a Beck smoothness of at least 100 seconds to the back surface of the base paper, and coating both the front and back surface of the base paper with a 15 to 50 μm polyolefin layer.

2. A process as claimed in claim 1, wherein said drier is a Yankee drier.

3. A support for photographic printing paper produced by a process comprising contacting a front surface of a wet paper having a front and a back surface and having a water content of between 50 to 80 wt % against the mirror surface of a mirror surface type drier which mirror surface is maintained in the range of 100° C. to 200° C., to obtain a base paper having a Beck smoothness of at least 300 seconds at the front surface of the base paper, further subjecting the paper to treatment as necessary to impart a Beck smoothness of at least 100 seconds to the back surface of the base paper, and coating both the front and back surface of the base paper with a 15 to 50 μm polyolefin layer.

4. A support as claimed in claim 3, wherein said polyolefin is selected from the group consisting of α-olefin homopolymers and polymers of mixtures of α-olefins.

5. A support as claimed in claim 3, wherein said polyolefin is selected from the group consisting of polyethylene and polypropylene

6. A support as claimed in claim 3, wherein said polyolefin has a molecular weight of from 20,000 to 200,000.

7. A support as claimed in claim 3, wherein said base paper contains at least 60% by weight broad-leafed tree pulp.

8. A support as claimed in claim 3, wherein said base paper comprises a mixture of a broad-leafed tree pulp and coniferous tree pulp in a 95/5 to 60/4 ratio.

* * * * *